US008141833B1

(12) United States Patent
Plummer et al.

(10) Patent No.: US 8,141,833 B1
(45) **Date of Patent: *Mar. 27, 2012**

(54) CONNECTOR FOR CONNECTING GRILLES TO DOORS

(75) Inventors: John B. Plummer, Houston, TX (US); Marjorie Plummer, Spring, TX (US); Joseph Gene Denley, Cypress, TX (US)

(73) Assignee: Glasscraft Door Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/842,939

(22) Filed: Jul. 23, 2010

(51) Int. Cl.
*A47B 96/06* (2006.01)

(52) U.S. Cl. ..... 248/229.1; 70/277; 248/229.2; 296/202

(58) Field of Classification Search ..... 248/229.1
See application file for complete search history.

(56) References Cited

U.S. PATENT DOCUMENTS

| | | | | | |
|---|---|---|---|---|---|
| 3,308,593 | A | | 3/1967 | Smith | |
| 3,791,095 | A | | 2/1974 | Martin | |
| 3,895,669 | A | * | 7/1975 | Heeling | 160/92 |
| 3,946,531 | A | | 3/1976 | Armstrong | |
| 4,204,015 | A | | 5/1980 | Wardlaw et al. | |
| 4,567,710 | A | | 2/1986 | Reed | |
| 4,644,688 | A | * | 2/1987 | Benderoff | 49/67 |
| 4,652,472 | A | | 3/1987 | Davies | |
| 4,783,938 | A | | 11/1988 | Palmer | |
| 4,796,384 | A | * | 1/1989 | Warwick | 49/55 |
| 4,989,384 | A | | 2/1991 | Kinghorn et al. | |
| 5,092,101 | A | | 3/1992 | Kunert | |
| 5,267,421 | A | | 12/1993 | Salisbury | |
| 5,345,743 | A | | 9/1994 | Baier | |
| 5,436,040 | A | | 7/1995 | Lafond | |
| 5,477,647 | A | | 12/1995 | Yates, Jr. | |
| 5,575,321 | A | * | 11/1996 | Currier | 160/90 |
| 5,834,124 | A | | 11/1998 | Pease, III et al. | |
| 5,981,631 | A | | 11/1999 | Ronden et al. | |
| 6,115,989 | A | | 9/2000 | Boone et al. | |
| 6,192,651 | B1 | | 2/2001 | Donaldson | |
| 6,345,485 | B1 | | 2/2002 | Boone et al. | |
| 6,434,985 | B1 | * | 8/2002 | Walmsley | 70/277 |
| 6,671,572 | B1 | | 12/2003 | Craft et al. | |
| 7,681,369 | B2 | | 3/2010 | Soltesiz et al. | |
| 7,743,570 | B2 | | 6/2010 | Reichert | |
| 7,949,422 | B1 | | 5/2011 | Little et al. | |
| 2007/0154663 | A1 | | 7/2007 | Wang et al. | |
| 2008/0006760 | A1 | | 1/2008 | Sibbett | |
| 2008/0047208 | A1 | | 2/2008 | Soltesiz et al. | |
| 2009/0139165 | A1 | | 6/2009 | Prete et al. | |
| 2010/0236167 | A1 | | 9/2010 | Parker | |

* cited by examiner

*Primary Examiner* — Terrell McKinnon
*Assistant Examiner* — Monica Millner
(74) *Attorney, Agent, or Firm* — Buskop Law Group, PC; Wendy Buskop

(57) ABSTRACT

A connector for connecting a grille to a door. The connector can include a first plate connected to a second plate at a right angle. A first tubular can extend at a right angle from the first plate for inserting into a door insert frame, such as in a screw boss. The first tubular can have a hole for receiving a fastener and fastening the connector to a door. A second tubular can be disposed proximate an intersection of the first plate and the second plate. The second tubular can have a hole extending at a right angle to the hole of the first tubular for receiving a pin that can be used to connect a grille to the connector.

17 Claims, 9 Drawing Sheets

CONNECTOR FOR CONNECTING GRILLES TO DOORS

FIELD

The present embodiments generally relate to a connector for connecting grilles to doors and the like.

BACKGROUND

A need exists for a connector for attaching a grille to a door in a removable and pivotable manner.

A further need exists for a connector adapted to engage a preexisting door insert for connecting a grille thereto.

The present embodiments meet these needs.

BRIEF DESCRIPTION OF THE DRAWINGS

The detailed description will be better understood in conjunction with the accompanying drawings as follows.

Figure 3:
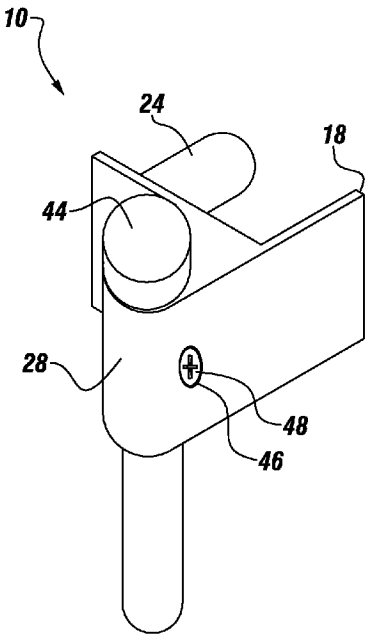
FIG. 3 depicts a profile view of an embodiment of the connector.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a connector for connecting grilles to doors and the like. The connector can be used to connect a grille onto an external surface of a door insert. The door insert can be installed into a door. A light assembly can be formed using the connector. The light assembly can include a door insert, an external grille, and a connector.

One or more embodiments have the unique benefit of being adapted such that the grille can be installed directly onto an industry standard door insert frame, rather than attaching the grille directly to the door, such as to the surface of the door, as is commonly done in the art.

The door insert can be an industry standard door insert, and can be inserted into a door, such as into an opening within a door. The door can be a fiberglass door, wooden door, steel door, or another door. The door insert can provide a decorative feature to the door. The door insert can be a framed translucent panel that can be installed into a door, including a door insert frame and at least one translucent panel. The door insert frame can be engaged over a first side and a second side of the translucent panel. The translucent panels of the door insert can be tempered safety glass panels that can be disposed or mounted into the door insert frame. The door insert can be made of aluminum, another metal, plastic, wood, a composite compound, or combinations thereof.

The door insert can include a translucent panel with a first side and a second side.

The translucent panel can be a glass panel, a Plexiglas® panel, a textured glass panel, an insulated glass panel, a tempered safety glass panel, an approved and certified safety material panel, a privacy window, another transparent and/or translucent panel or combinations thereof.

The door insert can include an exterior frame with a plurality of screw bosses and an exterior frame opening. The exterior frame can include from six to twenty screw bosses. The exterior frame can be disposed over the first side of the translucent panel, and the translucent panel can be disposed within or behind the exterior frame opening. The exterior frame can be made of metal, wood, plastic, a polymeric material, fiberglass, or another material. The screw bosses on the exterior frame are also herein referred to as exterior screw bosses.

The door insert can include an interior frame with a plurality of screw bosses and an interior frame opening. The interior frame can include from six to twenty screw bosses. The interior frame can be disposed over the second side of the translucent panel, and the translucent panel can be disposed within or in front of the interior frame opening. The screw bosses on the interior frame are also herein referred to as interior screw bosses.

The plurality of exterior screw bosses can be axially aligned with the plurality of interior screw bosses. Each exterior screw boss can be formed as a tubular extension extending from the exterior frame, and each interior screw boss can be formed as a tubular extension extending from the interior frame. Each screw boss can be tapered. Each screw boss can have a through hole or a conduit formed therein for receiving a fastener. For example, a fastener can engage through one of the plurality of interior screw bosses, through one of the plurality of exterior screw bosses, and can be fastened to the exterior screw boss, thereby attaching the interior frame to the exterior frame. The fastener can be threadably attached to the exterior screw boss. A fastener can be simultaneously disposed through each exterior screw boss and each interior screw bosses.

One or more embodiments can include an exterior frame and an interior frame connected without screw bosses, but by another connecting or fastening means or method.

The assembly can include at least one connector hole or conduit. The connector hole can be formed on a first side of the frame, and can be a hole at least partially disposed through the frame of the door insert. An exterior connector hole can be formed on a first side of the exterior frame and can be axially aligned with one of the plurality of interior screw bosses. An interior connector hole can be formed on a first side of the interior frame and can be axially aligned with one of the plurality of exterior screw bosses. In one or more embodiments, the connector hole can be formed within one of the screw bosses. For example, the connector hole can be an external screw boss or an internal screw boss that has been configured or adapted to receive a connector. The connector hole can have a stop formed therein. The stop can be a portion of the connector hole that has a diameter smaller than the rest of the connector hole, and a diameter larger than a first tubular of the connector. The first tubular can be inserted into the connector hole and can engage the stop within connector hole. In one or more embodiments, an external screw boss or an internal screw boss can be drilled-out using a drill to enlarge the screw boss such that the connector can be engaged therein.

The connector of the assembly can be engaged within a connector hole, such as within the exterior connector hole. The connector can be formed of steel, plastic, a reinforced plastic, a polymeric material, a metal, or another material. The connector can include a coating disposed on a surface of the connector.

One or more embodiments can include an exterior frame with a connector hole formed therein. The connector can be engaged within the connector hole and attached thereto. For example, the connector can be engaged within the connector hole and a fastener can be engaged with the connector opposite the exterior frame, thereby attaching the connector to the exterior frame. The fastener can be disposed between the exterior frame and the interior frame.

One or more embodiments can include an exterior frame with a connector hole formed therein, and an interior frame with a connector hole formed therein. The connector can be engaged within the one or both of the connector holes and attached thereto. For example, the connector can be engaged within the connector hole of the exterior frame, and a fastener can be engaged through the connector hole of the interior frame and with the connector, thereby attaching the connector to the exterior frame.

The connector can include a first plate or first flange. The first plate or first flange can be connected to a second plate or second flange at an angle, such as a right angle. Each plate can have a first side, a second side, a first edge, a second edge, a top edge, and a bottom edge. Each plate can have a width from about one half inch to about one and one-fourth inches and a height from about three-eighths of an inch to about two inches.

The connector can include a first tubular extending from the first side of the first plate at an angle, such as a right angle. The first tubular can extend parallel to the second plate. The first tubular can be disposed within the exterior connector hole, thereby attaching the connector to the exterior frame. The first tubular can have an inner diameter from about one-fifth of an inch to about three-twentieths of an inch.

The first tubular can be generally cylindrical and can include a hole, which can be a cylindrical hole, fastener hole, or conduit concentrically disposed within the first tubular. In one or more embodiments, the hole of the first tubular can extend through the first plate. The hole can be a fastener hole that can be adapted to receive a fastener for securing the connector to the exterior frame and thereby to the door insert. For example, the fastener hole can be threaded. When the first tubular is inserted into the connector hole, the fastener hole can be axially aligned with the interior screw boss that is axially aligned with the connector hole. A fastener can be inserted through the interior screw boss and threadably fastened into the fastener hole of the first tubular; thereby attaching the connector to the door insert.

In one or more embodiments, the first tubular can be disposed centrally between the top edge of the first plate and the bottom edge of the first plate. The first tubular can be offset from the first edge of the first plate. For example, the first tubular can be disposed closer to the second edge of the first plate than to the first edge of the first plate. The first tubular can be configured to engage within a connector hole within a frame of a door insert. The first tubular can be inserted into the connector hole such that the first tubular is fittingly engaged with the connector hole. When the first tubular is inserted into the connector hole, an exterior surface of the first tubular can fit flush against an interior surface of the connector hole.

A space can be formed on the first side of the first plate between the first tubular and the second plate. The space can be configured to receive a frame of a door insert. For example, when the first tubular is inserted into the connector hole, the space can be of a size such that a portion of the frame of the door insert fits within the space. With the first tubular inserted into the connector hole, the portion of the frame can fittingly engage within the space, can engage the first side of the first plate, and can engage the second side of the second plate. For example, with the first tubular inserted into the connector hole, the portion of the frame can fit flush against the first side of the first plate and against the second side of the second plate.

The connector can include a second tubular that can be disposed at or proximate an intersection of the first plate and the second plate. The second tubular can extend from the second side of the first plate at an angle, such as a right angle, and can have a curved exterior surface. The second tubular can be integrally formed with the first plate or connected thereto. The second tubular can be generally cylindrical and can include a hole, which can be a cylindrical hole, a fastener hole, a through hole, or a conduit concentrically disposed within the second tubular. The hole of the second tubular can extend perpendicular to the hole of the first tubular. The hole of the second tubular can have an inner diameter from about one-eighth of an inch to about one-half of an inch. The hole of the second tubular can be a fastener hole, such as a threaded hole, that can be adapted to receive a fastener for securing the connector to a grille; thereby attaching the grille to the door insert. The hole of the second tubular can have a smooth surface configured to allow the pin, the bolt, or the fastener to rotate within the hole.

The cylindrical hole of the second tubular can be a smooth surfaced hole that can be adapted to receive a pin, a bolt, or a fastener for securing the connector to a grille; thereby attaching the grille to the door insert.

One or more embodiments can include a tapped hole that can be disposed through the second tubular. The tapped hole can be a threaded hole. A fastener, such as a set screw, can be disposed through the tapped hole and can be engaged with the pin inside the second tubular; thereby securing the pin within the second tubular. In operation, when a pin is inserted into the second tubular, the fastener, or set screw, can engage through the tapped hole to secure to the pin, thereby providing a locking engagement between the pin and the second tubular.

In one or more embodiments, the first tubular, the second tubular, the first plate, and the second plate can be a single piece integral structure.

The external grille, also referred to as a grille, can be attached to the door insert such that the grille can be opened in a pivotable manner; thereby providing access to the door disposed behind the grille for cleaning and other purposes. In one or more embodiments, the grille can be permanently secured to the door insert.

The grille can be made of wrought iron, a polymeric material, plastic, metal, wood, a composite, fiberglass, high-density polypropylene, or another material. The grille can be rigid and strong to provide for safety and security. The grille can also add a decorative and sophisticated appearance to the door insert.

The grille can have a grille frame that can have a rectangular shape, a square shape, a circular shape, or another shape. The grille frame can have a grille top, a grille first side, a grille bottom, and a grille second side. The grille top, grille first side, grille bottom, and grille second side can each be individual pieces that are connected together to form a portion of the grille frame. An opening can be formed between the grille top, the grille sides, and the grille bottom. The grille frame can include square tubulars, round tubulars, L-shaped angled bars, or combinations thereof. The grille can have a grille portion that can be disposed within the opening of the grille frame. The grille portion can be a decorative grille and can include various shapes, designs, openings, linear portions, and curvilinear portions. The grille portion can be disposed over and can cover from about five percent to about ninety percent of the transparent panel.

At least one mount barrel can be attached to, formed on, welded to or otherwise disposed on the grille first side and/or the grille second side. The mount barrel can be formed as a generally cylindrical member having a hollow, a through hole, or a conduit. The through hole of the mount barrel can be adapted to receive a fastener, such as a pin or a bolt.

With the connector attached to the door insert, the grille can attached to the connector; thereby attaching the grille to the door. For example, the grille can be disposed or positioned such that the through hole of the mount barrel is concentrically and/or axially aligned with the second tubular of the connector. A pin, a bolt, or another fastener can be simultaneously engaged through the mount barrel and through the second tubular, thereby mounting the grille to the connector and to the door insert. The pin can include a pin body connected to a pin head. The pin can be made of steel, aluminum, plastic, a composite, a powder coated material, or combinations thereof. The pin body can be threaded, and can have a diameter of about three-tenths of an inch and a length of two inches. The pin head can have a diameter of about one-half of an inch.

The grille, when mounted to the connector and to the door insert, can be pivotable about the pin, such that a user can open the grille away from the door to provide access to the door or the translucent panel.

One or more embodiments can include multiple connectors, such as from about four connectors to about six connectors, connected to each side of the door insert, allowing for multiple points of attachment of the grille to one or both sides of the door. The grille can include one or more mount barrels on the grille first side and the grille second side, allowing for multiple points of attachment of the grille to one or both sides of the door. Each mount barrel can be engaged with a connector. The mount barrels disposed on the grille first side can all be axially and/or concentrically aligned with each other and disposed in a spaced apart relationship. The mount barrels disposed on the grille second side can all be axially and/or concentrically aligned with each other and disposed in a spaced apart relationship.

In one or more embodiments, the grille can include two mount barrels on each side, and a connector can engage each mount barrel for attaching the grille to the door. The grille, when mounted to at least one connector on the grille first side and to at least one connector on the grille second side, can be securely engaged with the door insert. In operation, for example, each pin attaching the grille first side to the door insert can be removed, allowing the grille to be pivoted about each pin attaching the grille second side to the door insert. Each connector of the assembly can be disposed within a connector hole that can be formed in substantially the same manner as described above. By removing each pin on one side of the grille and allowing the grille to pivot about the pins on the other side of the grille, a user can access the door, such as for cleaning, maintenance, or repair of the door.

The pin can be removable from the mount barrel and the second tubular of the connector. The grille can be removable from the connectors, allowing for attachment of an impact-resistant material to the connectors, and thereby to the door insert. The impact-resistant material can have a mount barrel as described above for attaching the impact-resistant material to the connectors. The impact-resistant material can be adapted to withstand forces from storms, hurricanes, tornadoes, tsunamis, and other hazards. The impact-resistant material can be plywood, plastic plates, metal slats, metal sheets, a composite material, a hurricane impact-resistant fabric mounted on a rigid frame, or another material.

Figure 1:
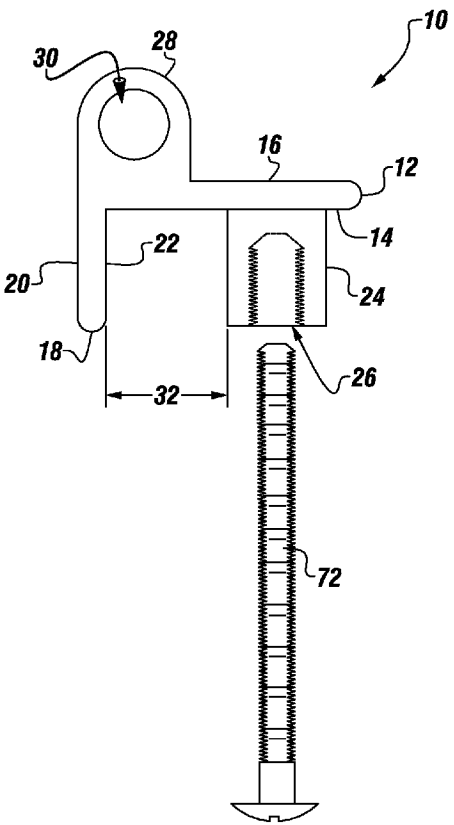
FIG. 1 depicts a top view of an embodiment of a connector.

Turning now to the Figures, FIG. 1 depicts a top view of an embodiment of a connector 10. The connector 10 can have a first plate 12 with a first plate first side 14 and a first plate second side 16.

The connector 10 can have a second plate 18 connected to the first plate 12. The second plate can have a second plate first side 20 and a second plate second side 22.

The connector 10 can have a first tubular 24 extending from the first plate 12. The first tubular 24 can have a fastener hole 26. A fastener 72 can engage within the fastener hole 26.

The connector can have a second tubular 28 disposed proximate an intersection of the first plate 12 and the second plate 18. The second tubular 28 can have a through hole 30 extending at a right angle to the fastener hole 26.

A space 32 can be formed on the first plate first side 14 between the first tubular 24 and the second plate 18.

Figure 2:
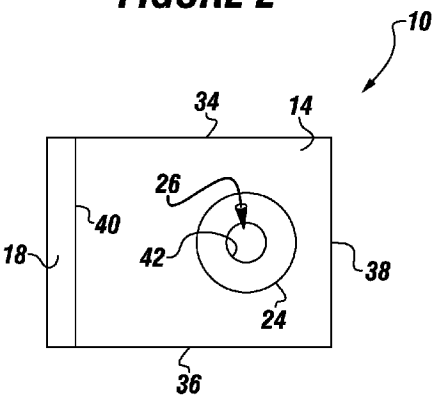
FIG. 2 depicts a side view of an embodiment of the connector.

FIG. 2 depicts a side view of the connector 10 with the first tubular 24 centered on the first plate first side 14 between a first plate top edge 34 and a first plate bottom edge 36. The first tubular 24 can be disposed closer to a first plate first side edge 38 than to a first plate second side edge 40. The first tubular 24 can have a smooth surface 42 within the fastener hole 26. Also depicted is the second plate 18.

FIG. 3 depicts a profile view of an embodiment of the connector 10 with a pin 44 disposed within the second tubular 28. The second tubular 28 can have a threaded hole 46 disposed therethrough. A set screw 48 can be disposed within the threaded hole 46. Also depicted is the first tubular 24 and the second plate 18.

Figure 4:
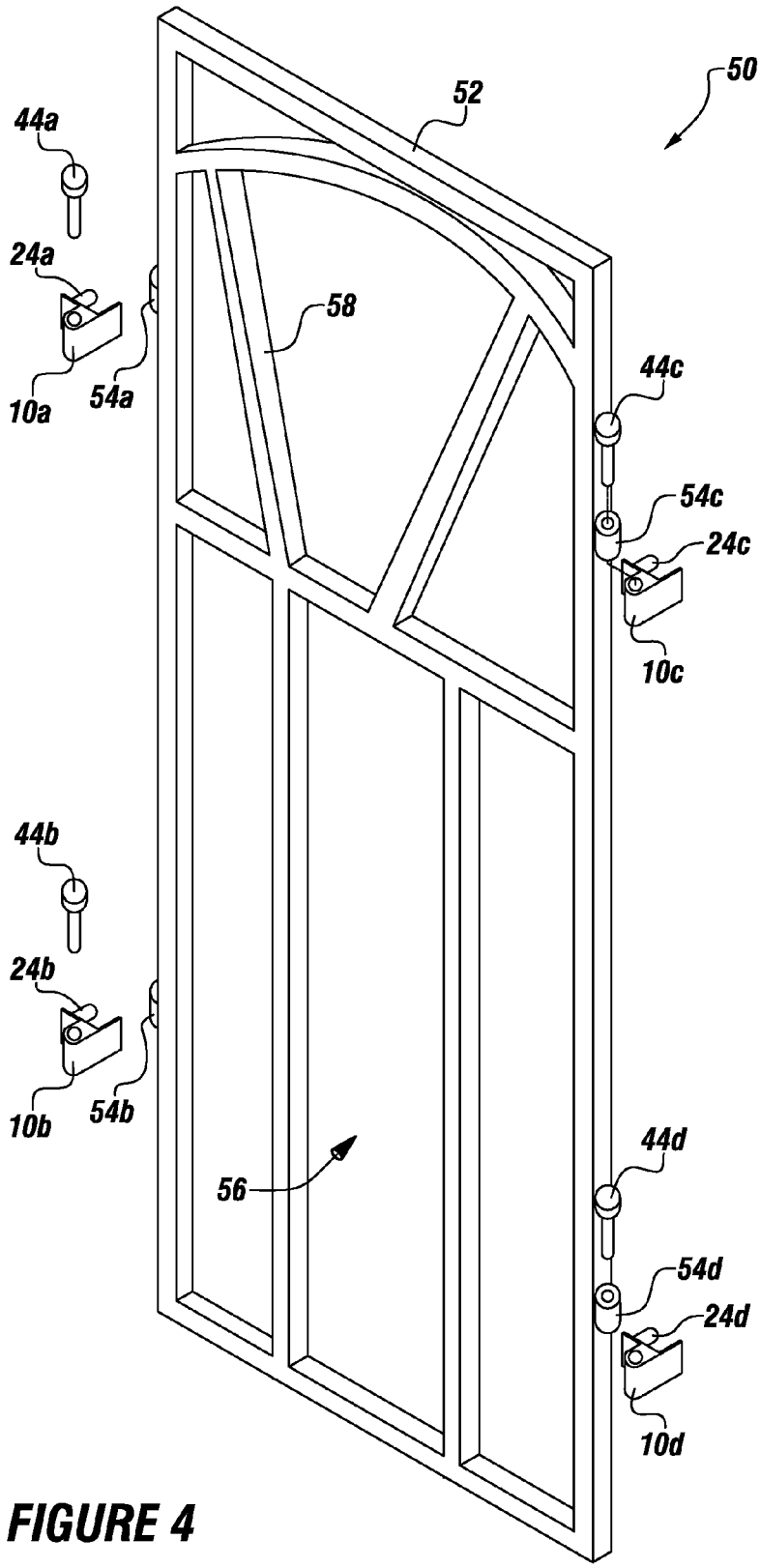
FIG. 4 depicts an exploded view of an embodiment of an external grille, connectors, and pins.

FIG. 4 depicts an exploded view of an embodiment of an external grille 50, which can be attached to one or more connectors, including connector 10*a*, connector 10*b*, connector 10*c*, and connector 10*d*. The external grille 50 can have a grille frame 52 with one or more mount barrels connected or disposed thereon, including mount barrel 54*a*, mount barrel 54*b*, mount barrel 54*c*, and mount barrel 54*d*. A pin can simultaneously engage one of the mount barrels and one of the connectors. Pin 44*a*, pin 44*b*, pin 44*c*, and pin 44*d* are depicted. The grille frame 52 can have an opening 56. Also depicted is an insert tubular 24*a*, an insert tubular 24*b*, an insert tubular 24*c*, and an insert tubular 24*d*.

Figure 5:
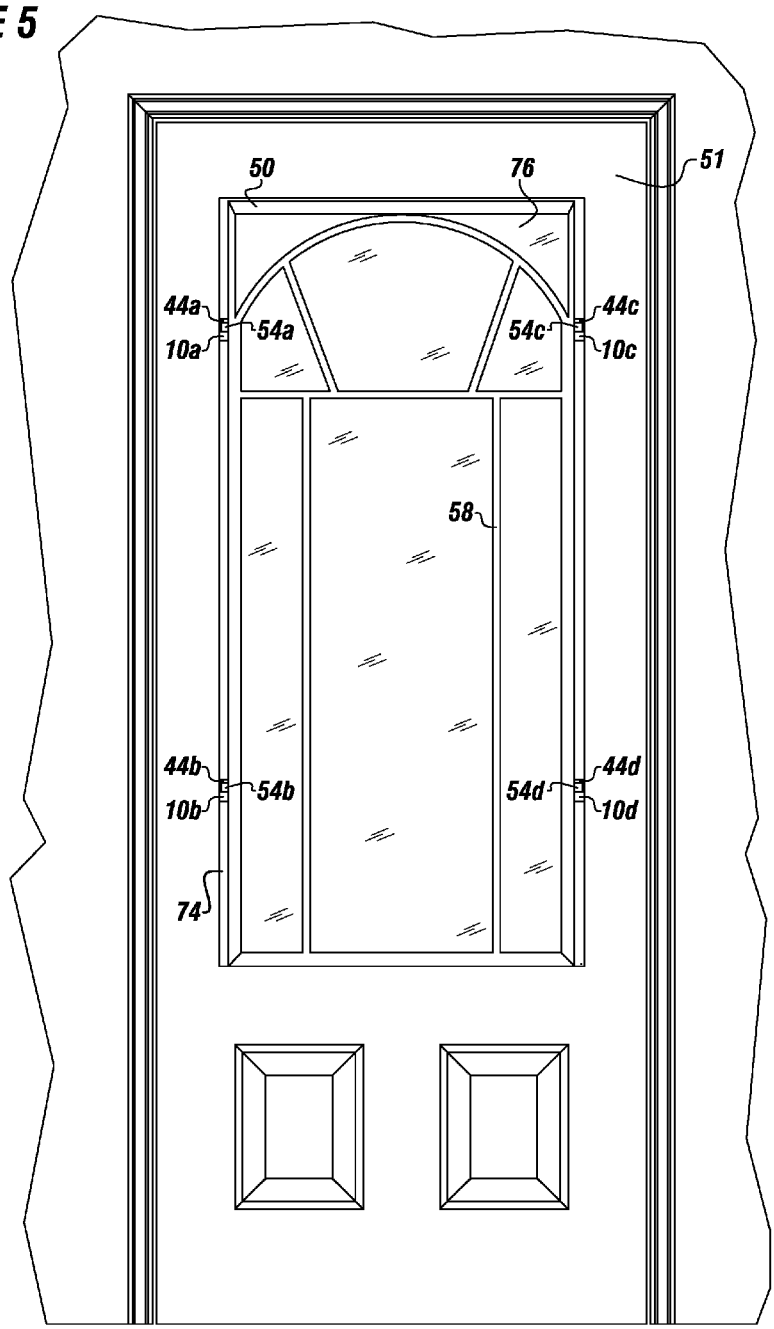
FIG. 5 depicts an embodiment of an external grille with connectors attached to a door.

FIG. 5 depicts an exploded view of an embodiment of an external grille 50 connected to a door 51. The external grille 50 is attached to a door insert 74 with connector 10*a*, connector 10*b*, connector 10*c*, and connector 10*d*. The door insert 74 is attached to the door 51. The door insert 74 can include a translucent panel 76.

A pin 44*a* can be simultaneously engaged with a mount barrel 54*a* of the external grille 50 and the connector 10*a*. A pin 44*b* can be simultaneously engaged with a mount barrel 54*b* of the external grille 50 and the connector 10*b*. A pin 44*c* can be simultaneously engaged with a mount barrel 54*c* of the external grille 50 and the connector 10*c*. A pin 44*d* can be simultaneously engaged with a mount barrel 54*d* of the external grille 50 and the connector 10*d*. The external grille 50 can include a grille design portion 58.

Figure 6:
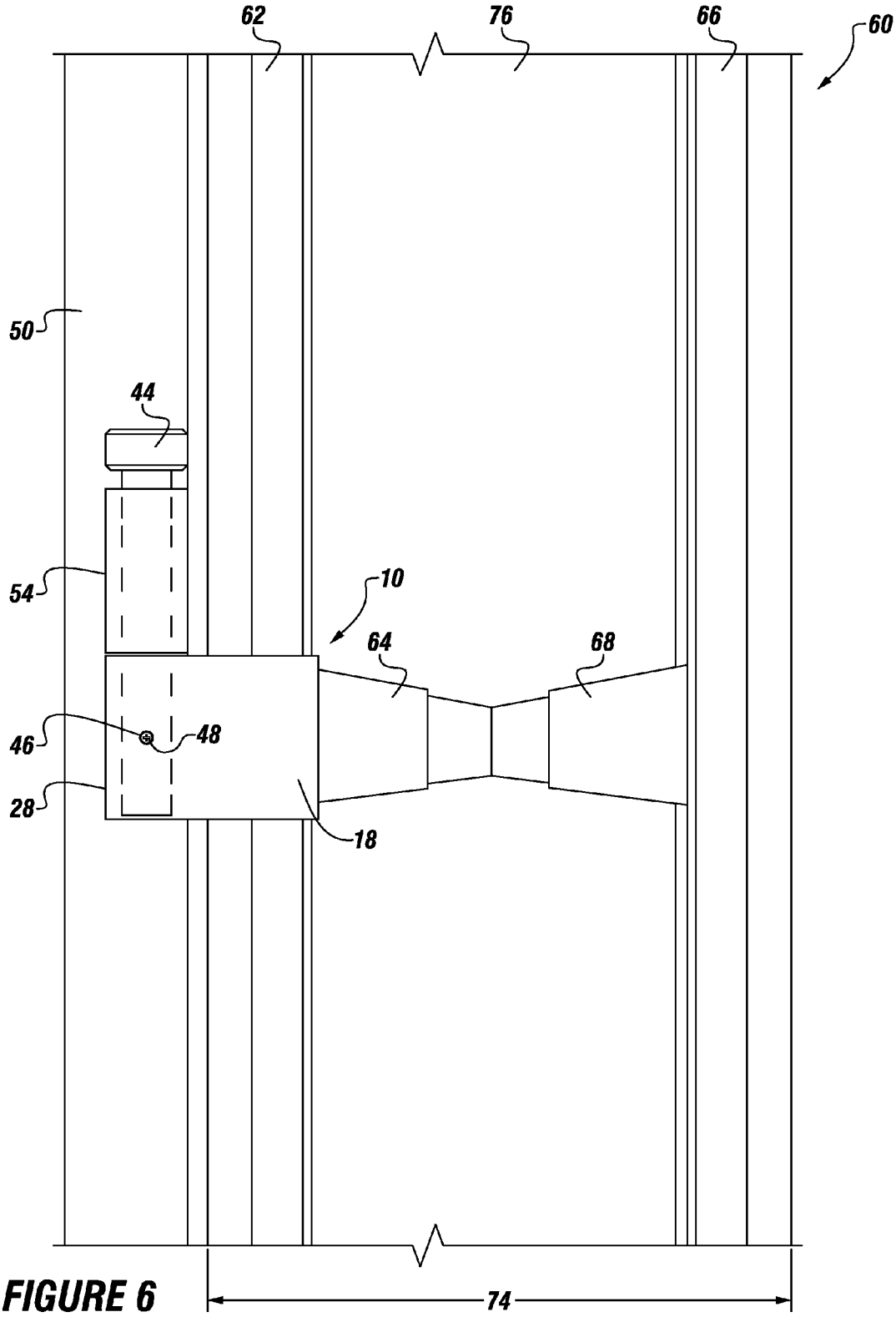
FIG. 6 depicts a cut view of an external grille assembly.

FIG. 6 depicts an assembled view of an embodiment of an external grille assembly 60. The external grille assembly 60 can include a door insert 74. The door insert 74 can include an exterior frame 62 with an exterior screw boss 64, an interior frame 66 with an interior screw boss 68, and a translucent panel 76 disposed there-between.

A pin 44 can engage through a mount barrel 54 of an external grille 50, and through the second tubular 28 of the connector 10; thereby attaching the external grille to the connector and to the exterior frame 62. Also depicted is a tapped hole 46, a set screw 48 and the second plate 18.

Figure 7:
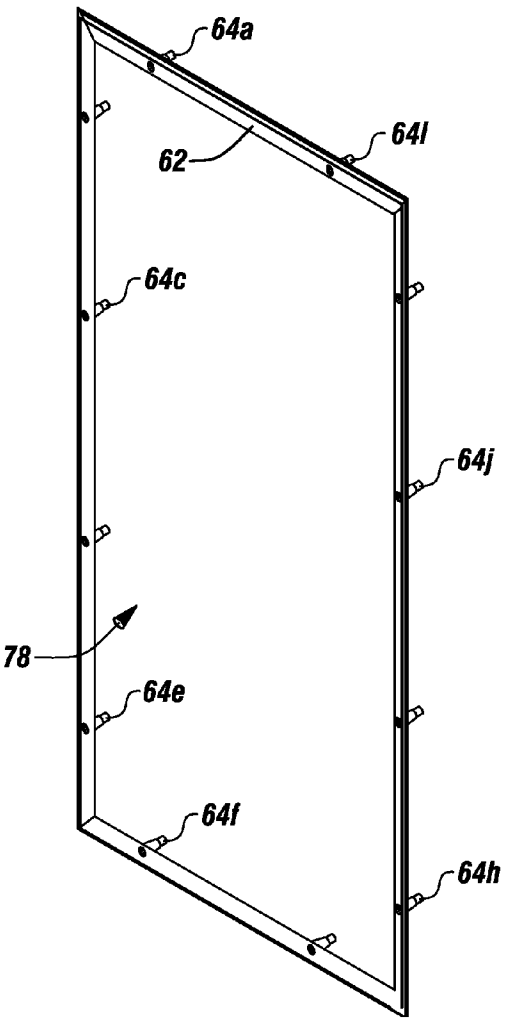
FIG. 7 depicts an embodiment of an external frame of a door insert.

FIG. 7 depicts a view of an exterior frame 62 including: an exterior frame opening 78 and a plurality of exterior screw bosses 64*a*, 64*c*, 64*e*, 64*f*, 64*h*, 64*j* and 64*l*.

Figure 8:
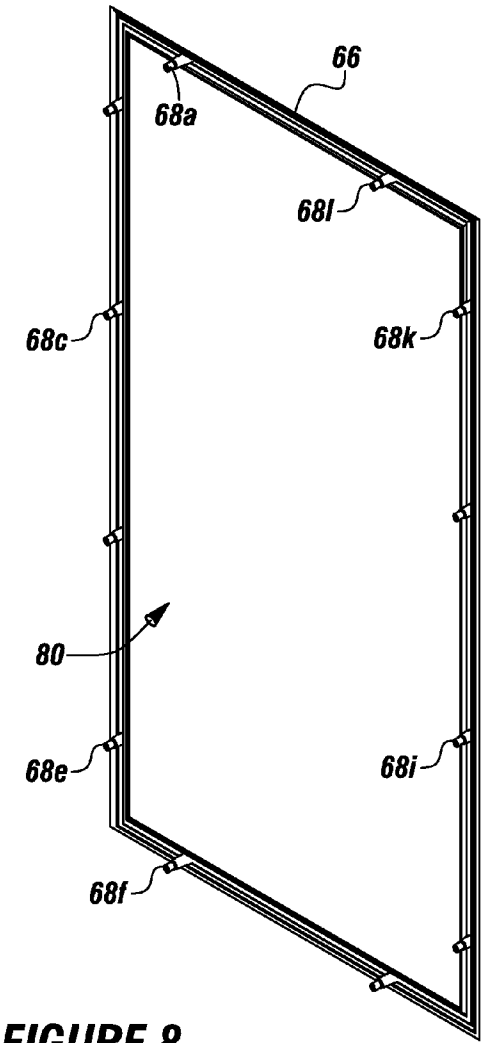
FIG. 8 depicts an embodiment of an internal frame of a door insert.

FIG. 8 depicts a view of an interior frame 66 including: an interior frame opening 80 and a plurality of interior screw bosses 68*a*, 68*c*, 68*e*, 68*f*, 68*i*, 68*k* and 681.

Figure 9:
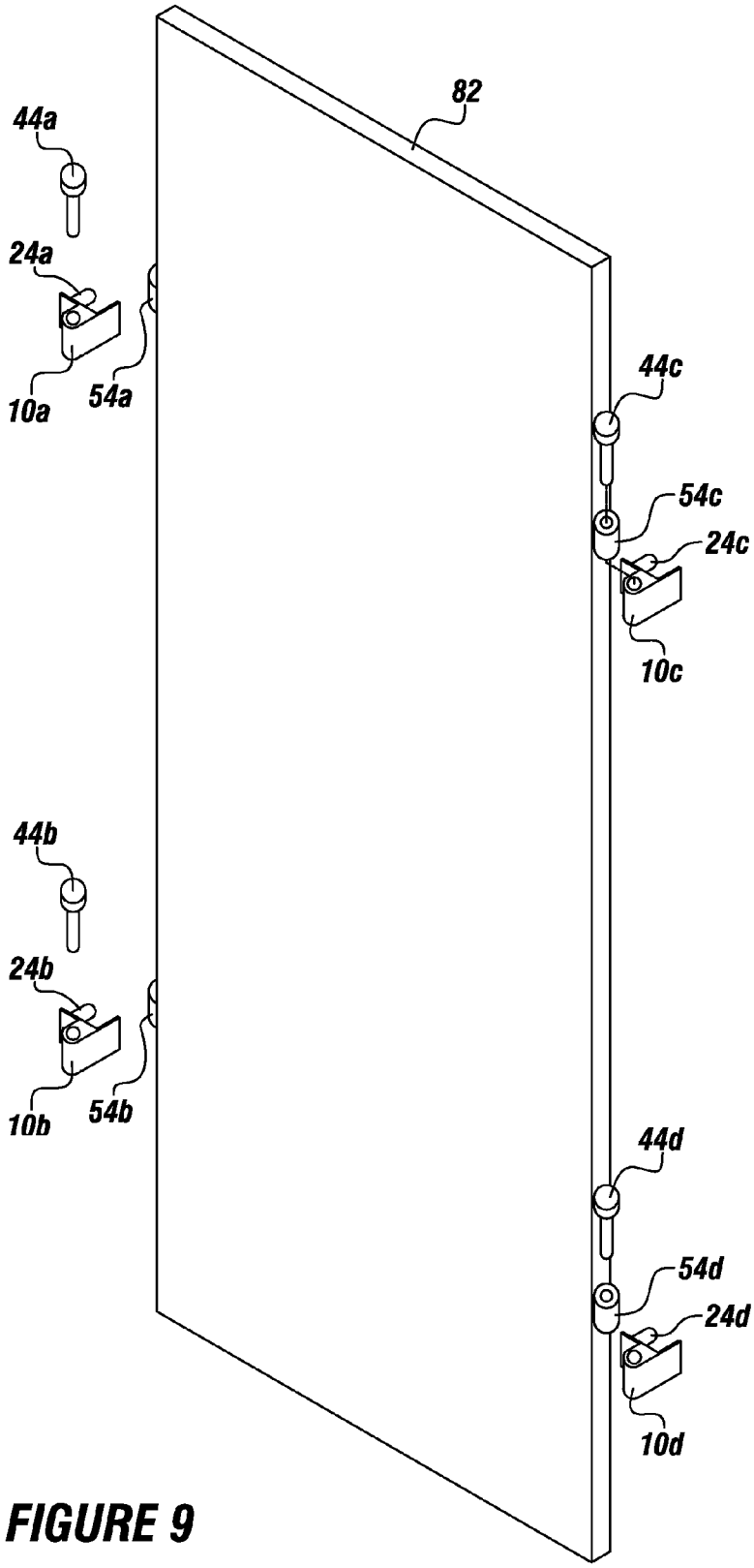
FIG. 9 depicts an exploded view of an embodiment of an impact-resistant material, connectors, and pins.

FIG. 9 depicts an embodiment of an impact-resistant material 82 that can be attached to a door insert using the connectors, including connector 10*a*, connector 10*b*, connector 10*c*, and connector 10*d*.

The impact-resistant material 82 can have one or more mount barrels connected or disposed thereon, including mount barrel 54*a*, mount barrel 54*b*, mount barrel 54*c*, and mount barrel 54*d*. A pin can simultaneously engage one of the mount barrels and one of the connectors. Pin 44*a*, pin 44*b*, pin 44*c*, and pin 44*d* are depicted. Also depicted is first tubular 24*a*, first tubular 24*b*, first tubular 24*c*, and first tubular 24*d*.

Figure 10:
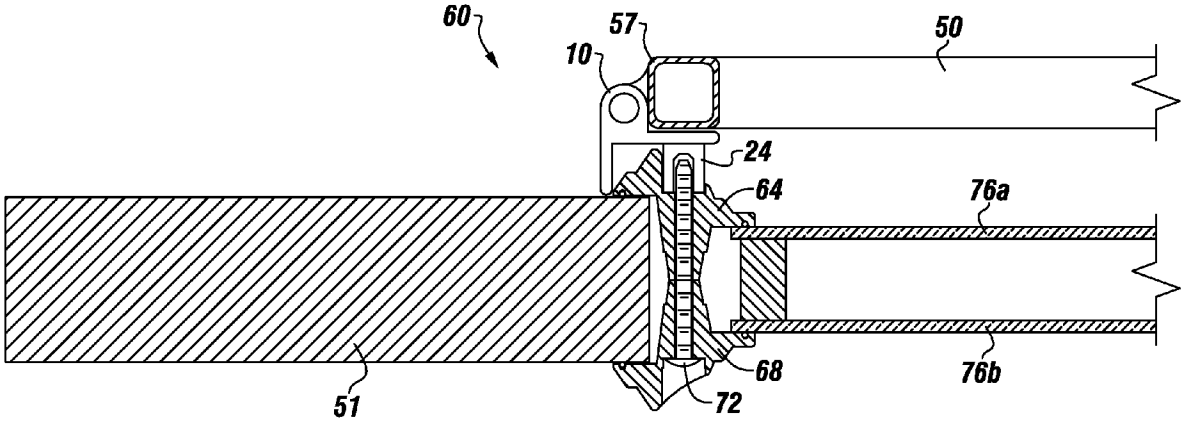
FIG. 10 depicts a top cut view of an embodiment of the external grille assembly.

FIG. 10 depicts a top cut view of an embodiment of the external grille assembly 60 with an external grille 50. A first tubular 24 of a connector 10 can be engaged within an exterior screw boss 64 of a door insert, such as with a connector hole. A fastener 72 can be threadably engaged with the first tubular 24 through the interior screw boss 68 and the exterior screw boss 64. The external grille assembly 60 can include a first translucent panel 76*a* and a second translucent panel 76*b*. The external grille assembly 60 can be connected to a door 51. The external grille 50 can be formed of one or more square tubulars, such as square tubular 57.

Figure 11:
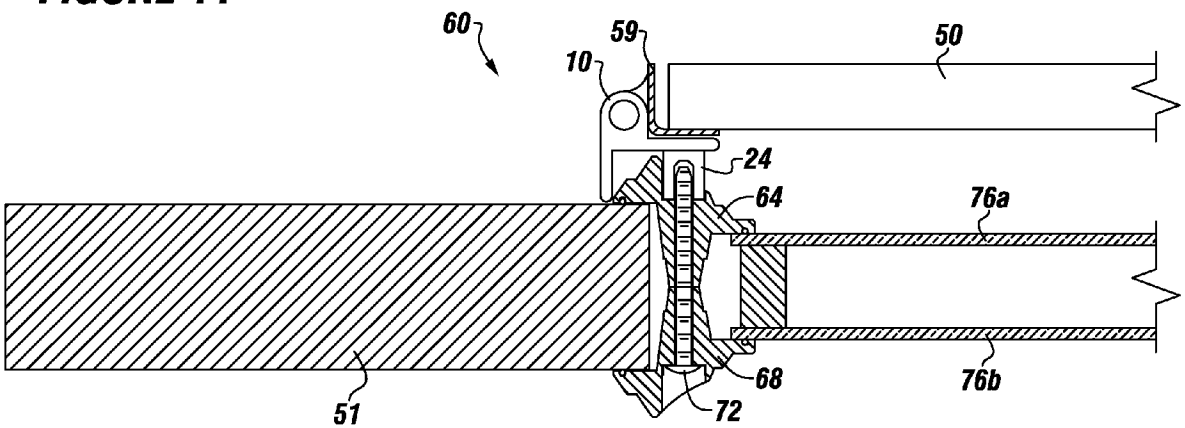
FIG. 11 depicts a top cut view of another embodiment of the external grille assembly.

FIG. 11 depicts a top cut view of an embodiment of the external grille assembly 60 with an external grille 50. A first tubular 24 of a connector 10 can be engaged within an exterior screw boss 64 of a door insert, such as with a connector hole. A fastener 72 can be threadably engaged with the first tubular 24 through the interior screw boss 68 and the exterior screw boss 64. The external grille assembly 60 can include a first translucent panel 76*a* and a second translucent panel 76*b*. The external grille assembly 60 can be connected to a door 51. The external grille 50 can be formed of one or more L-shaped tubulars, such as L-shaped tubular 59.

One or more embodiments relate a method for attaching an external grille to a door.

Figure 12A:
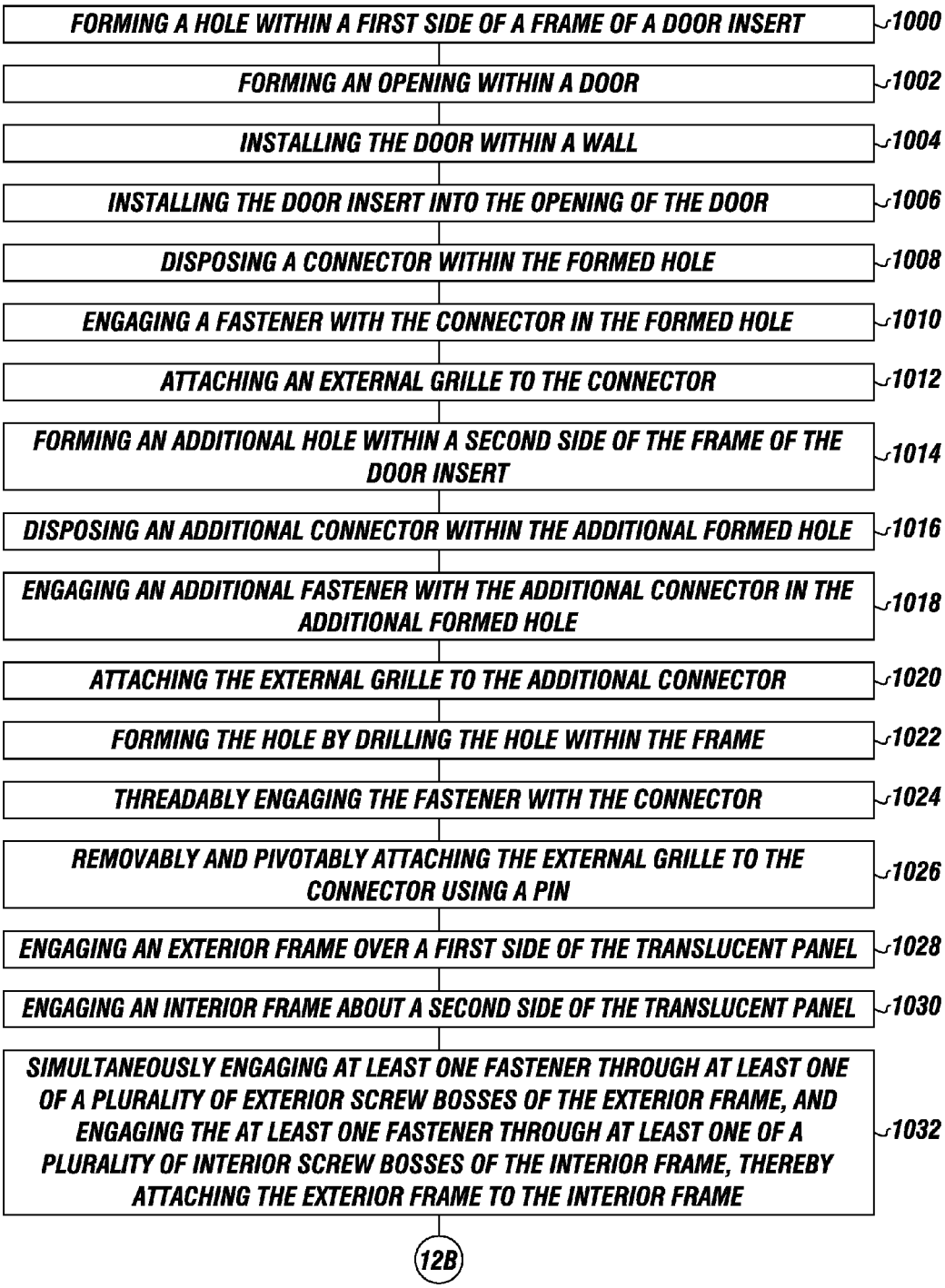
FIG. 12A depicts a flow chart of a method for attaching an external grille to a door.

FIG. 12A depicts an embodiment of a method for attaching an external grille to a door.

The method can include forming a hole within a first side of a frame of a door insert, as illustrated by box 1000.

The method can include forming an opening within a door, as illustrated by box 1002.

The method can include installing the door within a wall, as illustrated by box 1004.

The method can include installing the door insert into the opening of the door, as illustrated by box 1006.

The method can include disposing a connector within the formed hole, as illustrated by box 1008.

The method can include engaging a fastener with the connector in the formed hole, as illustrated by box 1010.

The method can include attaching an external grille to the connector, as illustrated by box 1012.

The method can include forming an additional hole within a second side of the frame of the door insert, as illustrated by box 1014.

The method can include disposing an additional connector within the additional formed hole, as illustrated by box 1016.

The method can include engaging an additional fastener with the additional connector in the additional formed hole, as illustrated by box 1018.

The method can include attaching the external grille to the additional connector, as illustrated by box 1020.

The method can include forming the hole by drilling the hole within the frame, as illustrated by box 1022.

The method can include threadably engaging the fastener with the connector, as illustrated by box 1024.

The method can include removably and pivotably attaching the external grille to the connector using a pin, as illustrated by box 1026.

The method can include engaging an exterior frame over a first side of the translucent panel, as illustrated by box 1028.

The method can include engaging an interior frame about a second side of the translucent panel, as illustrated by box 1030.

The method can include simultaneously engaging at least one fastener through at least one of a plurality of exterior screw bosses of the exterior frame, and engaging the at least one fastener through at least one of a plurality of interior screw bosses of the interior frame, thereby attaching the exterior frame to the interior frame, as illustrated by box 1032.

Figure 12B:
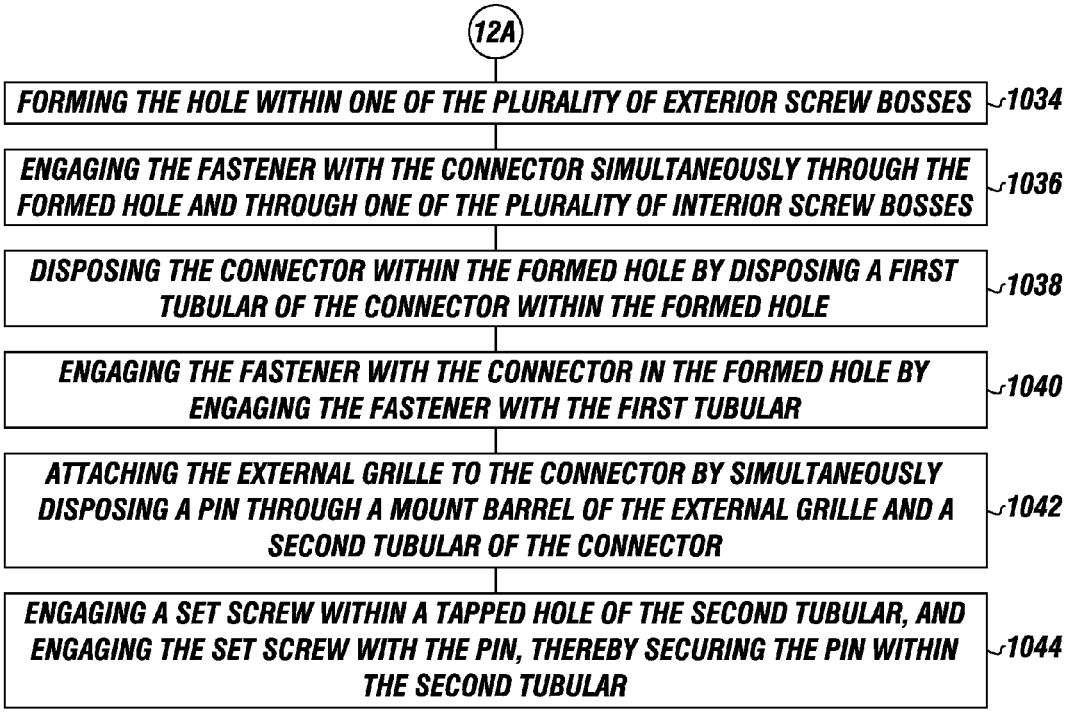
FIG. 12B is a continuation of FIG. 12A.

FIG. 12B is a continuation of FIG. 12A.

The method can include forming the hole within one of the plurality of exterior screw bosses, as illustrated by box 1034.

The method can include engaging the fastener with the connector simultaneously through the formed hole and through one of the plurality of interior screw bosses, as illustrated by box 1036.

The method can include disposing the connector within the formed hole by disposing a first tubular of the connector within the formed hole, as illustrated by box 1038.

The method can include engaging the fastener with the connector in the formed hole by engaging the fastener with the first tubular, as illustrated by box 1040.

The method can include attaching the external grille to the connector by simultaneously disposing a pin through a mount barrel of the external grille and a second tubular of the connector, as illustrated by box 1042.

The method can include engaging a set screw within a tapped hole of the second tubular, and engaging the set screw with the pin, thereby securing the pin within the second tubular, as illustrated by box 1044.

While these embodiments have been described with emphasis on the embodiments, it should be understood that within the scope of the appended claims, the embodiments might be practiced other than as specifically described herein.

What is claimed is:

1. A connector for connecting a grille to a door, the connector comprising:

a. a first plate comprising a first side, a second side, a top edge, a first side edge, a second side edge, and a bottom edge;

b. a second plate connected to the first plate at the second side edge, wherein the second plate extends from the first side of the first plate at a right angle to the first side of the first plate, and wherein the second plate comprises a first side and a second side;

c. a first tubular extending at a right angle from the first side of the first plate parallel to the extension of the second plate from the first side of the first plate, wherein a fastener hole is disposed within the first tubular; and d. a second tubular disposed at or proximate an intersection of the first plate and the second plate at or proximate the second side edge, wherein the second tubular is connected to the second side of the first plate, and wherein a through hole is disposed through the second tubular and extends at a right angle to the fastener hole.

2. The connector of claim 1, wherein:

a. the first tubular is centered on the first side of the first plate between the top edge and the bottom edge; and b. the first tubular is disposed closer to the first side edge of the first plate than the second side edge of the first plate.

3. The connector of claim 1, wherein the fastener hole is threaded.

4. The connector of claim 1, wherein the first tubular, the second tubular, the first plate, and the second plate are a single piece integral structure.

5. The connector of claim 1, wherein the through hole is configured to receive a pin, a bolt, or a fastener.

6. The connector of claim 5, further comprising:

a. a tapped hole disposed through the second tubular; and b. a set screw disposed within the tapped hole, wherein the set screw is configured to engage the pin, the bolt, or the fastener received by the through hole.

7. The connector of claim 5, wherein the through hole comprises a smooth surface configured to allow the pin, the bolt, or the fastener to rotate within the through hole.

8. The connector of claim 1, wherein the second tubular is threaded.

9. The connector of claim 1, wherein the second tubular comprises a curved exterior surface.

10. The connector of claim 1, wherein the fastener hole extends through the first plate.

11. The connector of claim 1, wherein the connector comprises: steel, plastic, reinforced plastic, polymeric material, metal, or combinations thereof.

12. The connector of claim 11, further comprising a coating disposed on the connector.

13. A connector for connecting a grille to a door, the connector comprising:

a. a first plate comprising a first side, a second side, a top edge, a first side edge, a second side edge, and a bottom edge;

b. a second plate connected to the first plate at the second side edge, wherein the second plate extends from the first side of the first plate, and wherein the second plate comprises a first side and a second side;

c. a first tubular extending from the first side of the first plate parallel to the extension of the second plate from the first side of the first plate, wherein a hole is disposed within the first tubular; and d. a second tubular disposed at or proximate an intersection of the first plate and the second plate on the second side of the first plate at or proximate the second side edge, wherein a through hole is disposed through the second tubular and extends at a right angle to the hole.

14. The connector of claim 1, further comprising a space formed on the first side of the first plate between the first tubular and the second plate.

15. The connector of claim 1, wherein the fastener hole is concentrically disposed within the first tubular, and wherein the through hole is concentrically disposed within the second tubular.

16. The connector of claim 13, further comprising a space formed on the first side of the first plate between the first tubular and the second plate.

17. The connector of claim 13, wherein the hole is concentrically disposed within the first tubular, and wherein the through hole is concentrically disposed within the second tubular.

* * * * *